US006886667B2

(12) United States Patent
Kunz et al.

(10) Patent No.: US 6,886,667 B2
(45) Date of Patent: May 3, 2005

(54) EQUIPMENT FOR ASCERTAINING THE POSITION OF A RAIL-GUIDED ELEVATOR CAR WITH A CODE CARRIER

(75) Inventors: René Kunz, Lucerne (CH); Eric Birrer, Lucerne (CH); Matthias Lorenz, Lucerne (CH)

(73) Assignee: Invento AG, Hergiswil NW (CH)

( * ) Notice: Subject to any disclaimer, the term of this patent is extended or adjusted under 35 U.S.C. 154(b) by 0 days.

(21) Appl. No.: 10/723,514

(22) Filed: Nov. 26, 2003

(65) Prior Publication Data

US 2004/0129504 A1 Jul. 8, 2004

Related U.S. Application Data

(63) Continuation of application No. PCT/CH02/00273, filed on May 22, 2002.

(30) Foreign Application Priority Data

May 31, 2001 (EP) ..... 01810528

(51) Int. Cl.[7] ..... B66B 3/02
(52) U.S. Cl. ..... 187/394
(58) Field of Search ..... 187/391, 393, 187/394, 312, 283, 397, 399; 701/208, 117; 340/905

(56) References Cited

U.S. PATENT DOCUMENTS

| | | | | | |
|---|---|---|---|---|---|
| 4,683,990 | A | * | 8/1987 | Wright | 187/394 |
| 4,750,592 | A | * | 6/1988 | Watt | 187/394 |
| 4,798,267 | A | * | 1/1989 | Foster et al. | 187/389 |
| 4,833,306 | A | * | 5/1989 | Milbrett | 235/375 |
| 5,023,434 | A | * | 6/1991 | Lanfer et al. | 235/375 |
| 5,360,085 | A | * | 11/1994 | Yoo et al. | 187/406 |
| 5,594,219 | A | * | 1/1997 | Kamani et al. | 187/394 |
| 5,821,477 | A | * | 10/1998 | Gerstenkorn | 187/394 |
| 5,925,859 | A | | 7/1999 | Miller et al. | |
| 6,128,116 | A | | 10/2000 | Dobler et al. | |
| 6,393,360 | B1 | * | 5/2002 | Ma | 701/208 |
| 6,435,315 | B1 | * | 8/2002 | Zaharia | 187/394 |
| 6,612,403 | B2 | * | 9/2003 | Silberhorn et al. | 187/394 |
| 6,622,827 | B1 | * | 9/2003 | Disieno | 187/394 |
| 2002/0025603 | A1 | * | 2/2002 | Ondricek et al. | 438/117 |

FOREIGN PATENT DOCUMENTS

| | | | | |
|---|---|---|---|---|
| DE | G 92 10 996.9 | | 12/1992 | |
| JP | 54131237 | A * | 10/1979 | B66B/1/36 |
| JP | 03208189 | A * | 9/1991 | G06K/7/08 |
| JP | 05085679 | A * | 4/1993 | B66B/5/10 |
| JP | 11209029 | | 8/1999 | |

* cited by examiner

*Primary Examiner*—Jonathan Salata
(74) *Attorney, Agent, or Firm*—Butzel Long

(57) ABSTRACT

Position transmitting equipment for ascertaining the position of a rail-guided elevator car includes a code carrier, which is arranged over the car travel path in fixed location on a guide rail with code marks of different permeability. A permanently precise reading of the coding is ensured by the fact that the code carrier is fixedly connected with a non-magnetic cover externally covering the code marks. The code carrier together with the outwardly facing non-magnetic cover are inserted into a receiving groove of the car guide rail, whereby a simple and reliable mounting is achieved and, in addition, temperature-dependent differences in expansion between the code carrier and the guide rail are avoided.

17 Claims, 4 Drawing Sheets

EQUIPMENT FOR ASCERTAINING THE POSITION OF A RAIL-GUIDED ELEVATOR CAR WITH A CODE CARRIER

This application is a continuation of PCT/CH02/00273, filed May 22, 2002.

BACKGROUND OF THE INVENTION

The present invention relates generally to elevator systems and, in particular, to equipment for ascertaining the absolute position of a rail-guided elevator car in an elevator shaft.

Such position transmitting equipment is known. In elevator installations, these are used for the purpose of determining the absolute position of an elevator car and deriving therefrom data signals for control of the elevator installation. The position information is applied in a coded form in fixed location along the entire travel path of the elevator car and is read off in the coded form by means of a code reading device and processed in evaluating equipment to be comprehensible to the control.

For example, equipment is known from German Utility Model G 92 10 996.9 in which a magnetic strip functioning as a code carrier is laterally fastened to a car guide rail. The magnetic strip contains, in the displacement direction of the elevator car, a length coding and coded data about stopping points or the like. A magnet head fastened to the elevator car and movable in common therewith relative to the magnetic strip in the reading direction of the coding reads off the coded data and passes on the data for evaluation.

Disadvantages of the known equipment consist in the previously usual application of the magnetic strip at or on the car guide rail and also in the construction of the magnetic strip itself. The magnetic strip has to be mounted at the guide rail in positionally exact manner and without overstretching in order to avoid misalignment of the coding with the corresponding position and inaccuracies, which result therefrom, for the positioning of the elevator car. Moreover, unequal thermal expansions of the magnetic strip relative to the car guide rail occur, which has the consequence of a displacement of the coding relative to the guide rail. In addition, the exposed position of the magnetic strip laterally at the guide rail involves the risk of mechanical damage to the magnetic strip by parts moved in the shaft, such as, for example, the magnet head in the case of horizontal movements of the elevator car. The known magnetic strip clogs with lubricating oil and dust particles swirled up in the shaft, which impairs reading of the coding.

SUMMARY OF THE INVENTION

The present invention concerns equipment for ascertaining the absolute position of a elevator car movable along guide rails over a travel path in an elevator installation comprising: a code carrier adapted to extend along the travel path of the elevator car and having code marks of different permeability alternately in succession extending in the direction of travel of the elevator car; and a non-magnetic cover attached to the code carrier and externally covering the code marks. The non-magnetic cover is formed of a metallic material and the code carrier is adapted to be retained in location on at least one of the guide rails along which the elevator car moves. A receiving groove is formed in the at least one guide rail, the code carrier being inserted into the receiving groove and being externally covered by the non-magnetic cover.

It is the object of the present invention to provide position transmitting equipment for elevators, which is favorable with respect to maintenance and which ensures a permanently precise reading of the absolute coding.

According to the present invention the attainment of this object is by equipment for ascertaining the position of the elevator car, which is distinguished particularly by the fact that the code carrier is fixedly connected with a non-magnetic cover, wherein the code marks are externally covered by means of the non-magnetic cover.

The advantages achieved by the present invention are that the code carrier and thus the coding is protected against mechanical damage by parts moved in the shaft. The non-magnetic cover moreover acts as a mechanical reinforcement for the code carrier and thereby prevents, during mounting, misalignment of the coding by non-uniform stretching of the code carrier in the direction of reading.

A further increase in the reliability and accuracy of the positional determination is to be achieved with a code carrier which is constructed as a magnetic strip carrying the code and a non-magnetizable cover, in the form of a metallic cover strip, fixedly connected therewith. Apart from high mechanical strength, a more favorable thermal balance between the code carrier and the guide rail is achieved with such a code carrier. This counteracts temperature-induced unequal thermal expansions, which occur over the length of the code carrier, relative to the guide rail or evens out the occurring difference in expansion.

In a further development of the present invention it is provided that the code carrier together with the outwardly facing cover is inserted into a receiving groove of the guide rail. The receiving groove enables a simple and precise mounting of the code carrier, because this merely has to be inserted without additional aids into the constructionally provided receiving groove. The magnetic strip carrying the coding is protectively covered towards all sides. The code carrier inserted into the receiving groove is embedded in the guide rail and covered towards the outside by the cover and accordingly substantially adopts the temperature thereof. Temperature-induced differences in expansion between the code carrier and the guide rail accordingly do not occur.

Particularly in the case of a receiving groove, which is shaped to be complementary to the code carrier and in which the code carrier is inserted to be flush relative to the surface of the guide rail, the code carrier is prevented from being erroneously displaced or bent—whereby the coding would be misaligned or unreadable—by parts moved in the shaft or by, for example, an engineer during maintenance operations.

In an advantageous manner the receiving groove is formed at the end face at a guide flange of the car guide rail. The production of the receiving groove is simple and the code carrier is readily accessible to the code reading device for reading the code.

A contact and space-saving mode of construction of the elevator is possible in the case of an embodiment in which the receiving groove is formed laterally at a guide flange of the car guide rail. This arrangement in addition favors accurate reading of the code with the assistance of the code reading device.

Advantages with respect to a quick and accurate mounting of the code carrier and the production of the equipment according to the present invention are offered by an embodiment in which the cover is formed as a strip with substantially two mutually parallel surfaces and lateral boundaries, wherein at least the lateral boundaries laterally project beyond the code carrier and the groove flanks of the receiving groove are formed to be complementary to the lateral boundaries of the cover strip.

The code carrier is preferably fastened to the guide rail in magnetic self-adhering manner. This enables a simple and timesaving mounting. At the same time, the code carrier bears directly against the guide rail and favors thermal transmission between the two. The code carrier follows every movement of the guide rail without the bond loosening or the code carrier experiencing local buckling.

In forms of embodiment with the code carrier arranged laterally at the guide flange of the car guide rail, the receiving groove lies in a region of the guide flange which is dynamically highly loaded when the elevator car is travelling. In order to avoid stress concentrations stemming from the receiving groove in this region it is advantageous to treat the foot region of the guide flange by hot-rolling.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
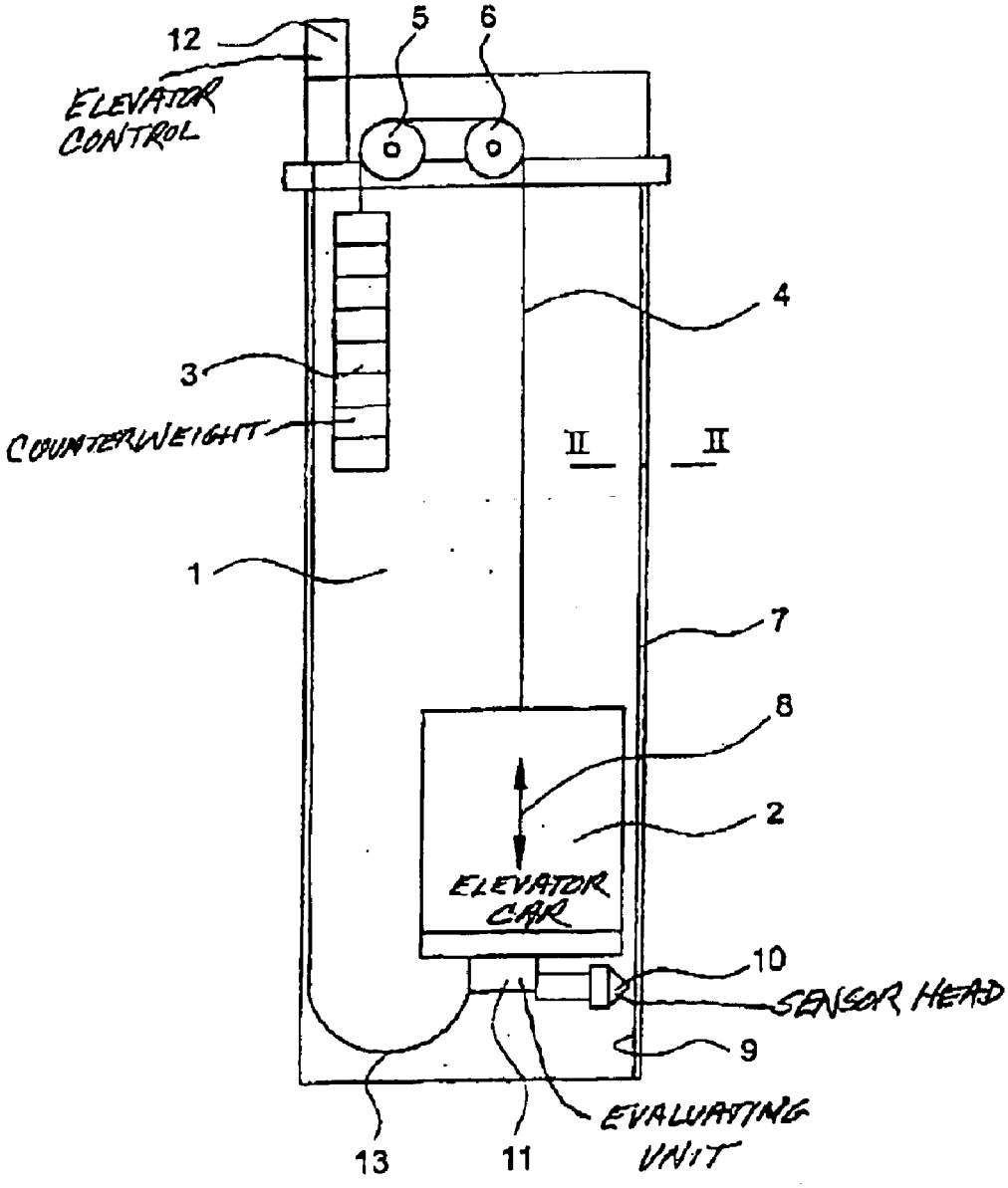
FIG. 1 schematically shows an elevator with a first embodiment of the position transmitting equipment according to the present invention.

FIG. 1 shows an elevator installation with a shaft 1 in which an elevator car 2 and a counterweight 3 are suspended on a common support cable 4. The support cable 4 is guided over a non-driven deflecting roller 5 and a driven drive pulley 6 and is driven by the latter. The drive pulley 6 transmits the drive forces of a drive motor, which is not illustrated here, for raising and lowering the elevator car 2 and the counterweight 3 on the support cable 4 driven by it. The elevator car 2 is vertically displaceable along a guide rail 7. A code strip 9 is mounted along the guide rail 7 parallel to a direction 8 of movement of the elevator car 2. The code strip 9 contains, in the direction 8 of movement of the elevator car 2, coded length or position details and coded data about stopping points or the like. The coded data are read off by a sensor head 10 and passed on to the evaluating unit 11.

The sensor head 10 is arranged at the elevator car 2 and moved together therewith along the code strip 9. For reading off the coding of the magnetic strip the sensor head 10 is equipped with correspondingly suitable sensors. Suitable for this purpose are, for example, Hall sensors, induction transmitters or—as in the illustrated embodiment—magnetoresistive sensors, so-called MR sensors, detecting the magnetic field direction. Of each of these types of sensors, there can be provided several individual sensors and/or one group of different sensors.

The coded information read off by the sensor head 10 is passed on to an evaluating unit 11. The evaluating unit 11 translates the coded information into a form comprehensible for an elevator control 12 before it is passed on, for example by way of a hanging cable 13 as shown, to the elevator control 12 for positioning the elevator car 2.

Figure 2A:
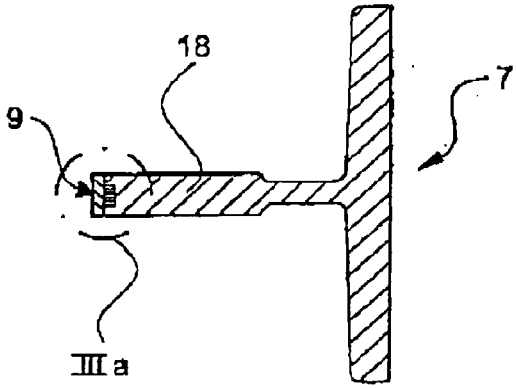
FIG. 2*a* shows a first embodiment of the magnetic strip according to the present invention and its application to the guide rail in an enlarged section taken along the section line II—II in FIG. 1.

In a horizontal section, which is illustrated in FIG. 2*a*, of the guide rail 7 the code strip 9 consists of a magnetic strip 14 and a metallic cover strip 15. Suitable for this purpose is basically any material which offers mechanical protection for the magnetic strip 14 or the code marks. The magnetic strip 14 is centrally glued onto the metallic cover strip 15, wherein the cover strip 15 projects at both sides beyond the magnetic strip 14. The magnetic strip 14 is inserted into a receiving groove 16 at an end face 17 of a guide flange 18 of the guide rail 7 and is covered relative to the shaft 1 by the metallic cover strip 15.

The magnetic strip 14 consists of vulcanized nitrile rubber as binder, in which aligned barium ferrite is embedded. In general, the magnetic strip can be formed from a synthetic material or rubber material in which any magnetizable material can be embedded. The magnetizable material is magnetized either as a magnetic north pole or as a magnetic south pole in alternating sequence in the form of sections extending transversely to the length direction of the magnetic strip. The magnetized sections form magnetic fields appropriately oriented outwards and represent the code marks of the magnetic strip 14. According to the respective polarity of the code marks, thus two different values "0" and "1" can be represented as basic components of the coding.

The non-magnetized metallic cover strip 15 serves for protection of the magnetic strip 14 against mechanical damage by parts moved in the shaft 1, for example the sensor head 10, and for compensation for unequal thermal expansions, which occur over the strip length, of the magnetic strip 14 relative to the guide rail 7. As mechanical reinforcement of the magnetic strip 14 it prevents a non-uniform expansion of the magnetic strip 14 and thus misalignment of the coding during mounting. Due to its non-magnetic property the magnetic code marks of the magnetic strip 14 also remain readable through the cover strip 15 by the sensor head 10.

The receiving groove 16 is machined over the entire length of the end surface 17 of the guide flange 18 and has a cross-section—here rectangular—complementary to the shape of the magnetic strip 14. The code strip 9 is retained in fixed location in the receiving groove 16 in magnetic self-adhering manner with the aid of the magnetic coding of the magnetic strip 14. A fixed bonding, for example by means of a screw connection at the upper end of the guide path, serves as a positional security for the magnetic strip 14. In addition, glue points at uniform spacings over the length of the receiving groove 16 serve for fixing the magnetic strip (not illustrated). However, in the case of a sufficient magnetic self-adhesion of the magnetic strip, gluing is not absolutely necessary.

Figure 2B:
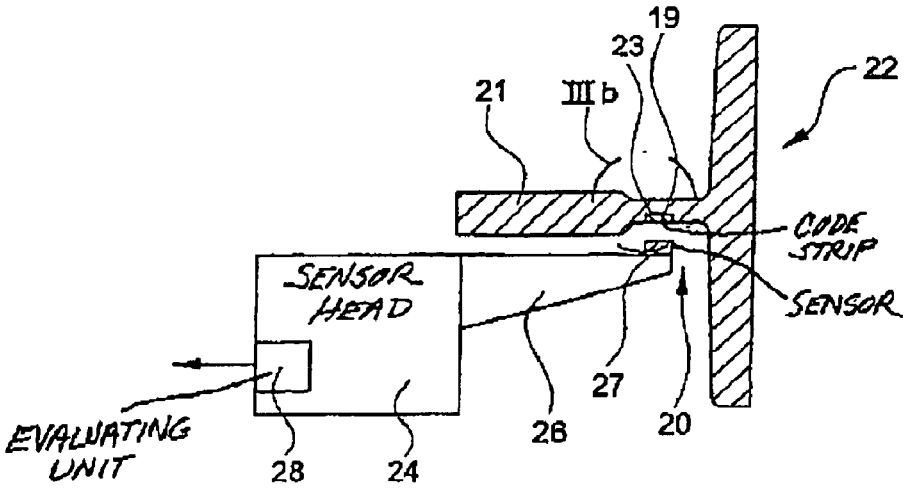
FIG. 2*b* shows a second embodiment of the magnetic strip according to the present invention and its application laterally to the guide rail in an enlarged section as if taken along the section line II—II in FIG. 1.

FIG. 2*b* shows an alternate embodiment of the equipment according to the present invention in which a code strip 19 is inserted, so as to be flush, in a receiving groove 23 formed laterally at a foot 20 of a guide flange 21 of a guide rail 22. A sensor head 24 is moved together with the elevator car 2 in the vertical direction 8. There is again arranged at a carrier 26 of the sensor head 24 a sensor 27 which reads off the coded information of the code strip 19, which is then passed on to an evaluating unit 28.

Figure 3A:
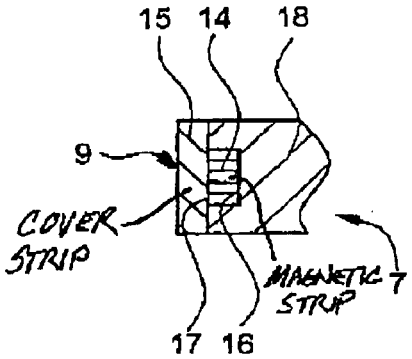
FIG. 3*a* shows a detail view of the end face of the guide flange in a circle IIIa shown in FIG. 2*a;*
Figure 3B:
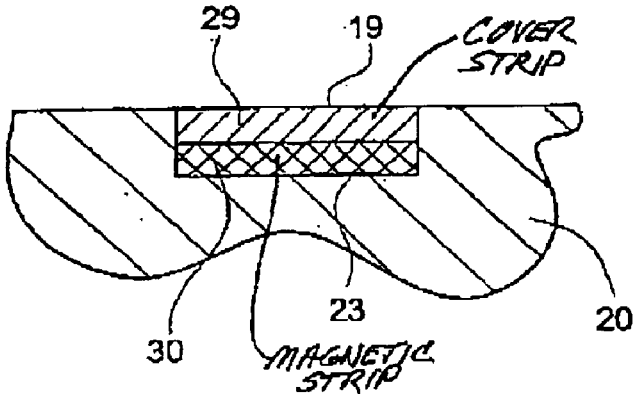
FIG. 3*b* shows a detail view of the embodiment of FIG. 2*b* in a circle IIIb.

FIG. 3*b* illustrates a detail view IIb of the embodiment of FIG. 2*b*. The code strip 19 with substantially rectangular cross-section is inserted, together with a metallic non-magnetic cover strip 29, to face outwardly and be flush in the complementary receiving groove 23 of the guide flange. A magnetic strip 30 is fixedly attached or adhered to the code strip 19 by the metallic non-magnetic cover strip 29.

Figure 3C:
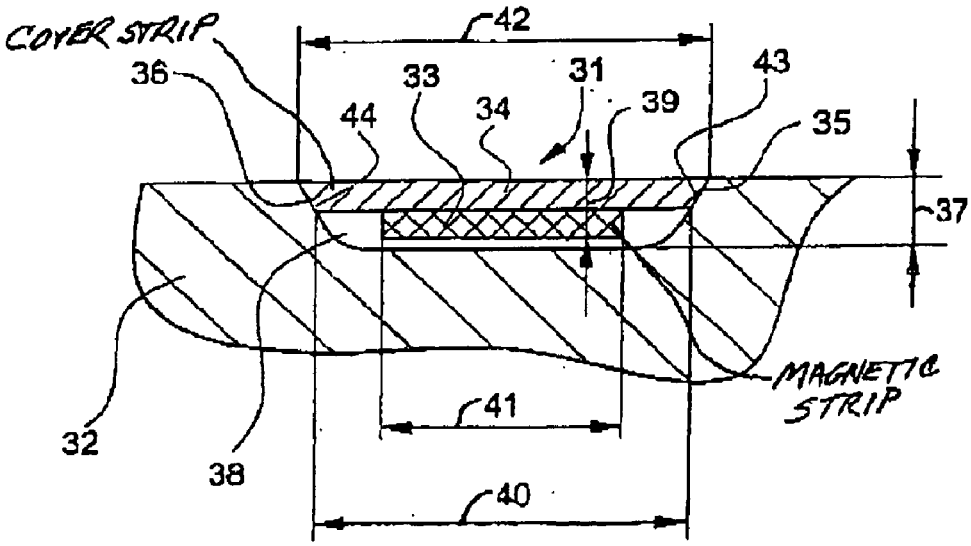
FIG. 3*c* shows a third embodiment of the magnetic strip according to the present invention and its application to the guide rail.

In FIG. 3*c* there is illustrated a third embodiment of the code carrier as a code strip 31 and its application to a guide rail 32. The code strip 31 consists, as in the previously described embodiment, again of a magnetic strip 33 and a cover strip 34 fixedly attached or glued thereto. The magnetic strip 33 corresponds in construction and function to the magnetic strip 14 of the embodiment illustrated in FIG. 3*a*. The cover strip 34 has a trapezium-shaped cross-section and projects symmetrically at both sides beyond the magnetic strip 33. Lateral boundaries 35, 36 of the cover strip 34 are beveled towards the magnetic strip 33.

A groove depth 37 of a receiving groove 38 is greater than a thickness 39 of the code strip 34. A width 40 of the receiving groove 38 is selected to be greater than a width 41 of the magnetic strip 33, whilst a width 42 of the cover strip 34 is basically the clear width 40 of the receiving groove 38. Side surfaces 43, 44 of the receiving groove 38 and the lateral boundaries 35, 36 of the cover strip 34 are formed to be complementary to one another. In the mounted state, the cover strip 34 is flush with the surface of the guide rail 32. The position of the magnetic strip 33 is specifically predetermined by the fixedly connected cover strip 34. The receiving groove 38 can be economically produced with large production tolerances, because merely the side surfaces 43, 44 at the readily accessible upper edge of the receiving groove 38 have to be formed to be complementary with the lateral boundaries 35, 36 of the cover strip 34.

In the case of embodiments with code carriers arranged laterally at the guide flange of the car guide rail, the receiving groove lies in a region of the guide flange which is dynamically highly loaded when the elevator car is moving. In order to avoid stress concentrations, which stem from the receiving groove, in this region, the foot region of he guide flange can be pretreated by hot-rolling.

Figure 4A:
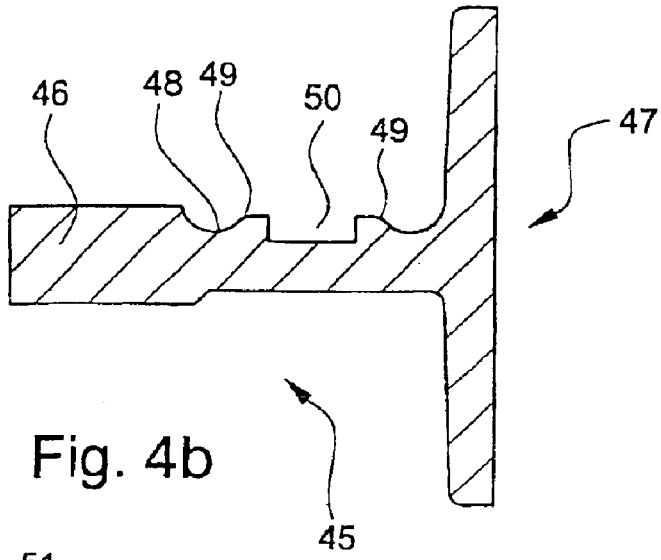
FIG. 4*a* shows a fourth embodiment of a receiving groove laterally at the guide rail according to the present invention.

According to FIG. 4*a*, a bead 48 with stress-accommodating transitions 49 is formed in a foot region 45 of a guide flange 46 over a length of a guide rail 47. A receiving groove 50 is then machined into the bead 48 by metal cutting.

An embodiment, which is alternative to the bead 48, without weakening the foot region 45 proposes compensation for the receiving groove laterally by a rolled-on rib at least on one side.

Figure 4B:
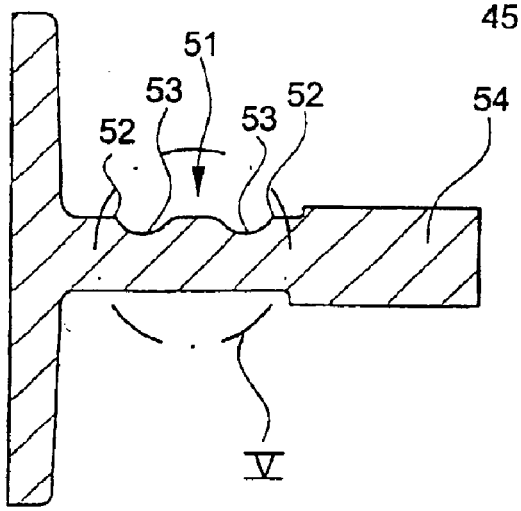
FIG. 4*b* shows a fifth embodiment of the receiving groove laterally at the guide rail according to the present invention.
Figure 5:
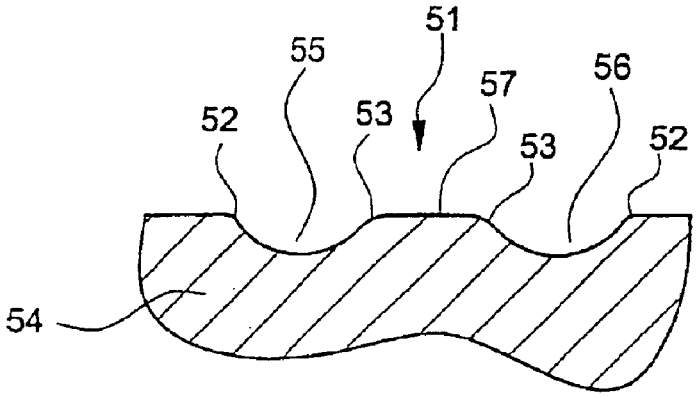
FIG. 5 shows a detail view V of the receiving groove from FIG. 4*b* in a circle V.

FIG. 4*b* shows a receiving groove 51 with radiussed transitions of groove flanks 52, 53, which is formed in a guide flange 54 by rolling. In a detail view V according to FIG. 5 it can be recognized that two mutually spaced-apart and parallel channels 55, 56 are formed over the length of the guide rail by rolling. A region 57 between the channels 55, 56 is processed by metal cutting, for example milled, and forms a planar support surface for a code strip (not illustrated).

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment for ascertaining the absolute position of an elevator car movable along guide rails over a travel path in an elevator installation comprising:

a code carrier adapted to extend and be fixed along the travel path of the elevator car and having code marks of different magnetic permeability alternately in succession extending in the direction of travel of the elevator car; and a non-magnetic cover attached to said code carrier and externally covering said code marks.

2. The equipment according to claim 1 wherein said non-magnetic cover is formed of a metallic material.

3. The equipment according to claim 1 wherein said code carrier is adapted to be retained in location on at least one of the guide rails along which the elevator car moves.

4. The equipment according to claim 3 including a receiving groove formed in the at least one guide rail, said code carrier being inserted into said receiving groove and being externally covered by said non-magnetic cover.

5. The equipment according to claim 4 wherein said receiving groove is formed laterally at a guide flange of the at least one guide rail.

6. The equipment according to claim 4 wherein said receiving groove is formed at an end face of a guide flange of the at least one guide rail.

7. The equipment according to claim 4 wherein said non-magnetic cover is inserted into said receiving groove to be flush with an outer surface of the at least one guide rail.

8. The equipment according to claim 4 wherein said non-magnetic cover is formed as a strip with lateral boundaries projecting laterally beyond said code carrier, and wherein lateral surfaces of said receiving groove and said lateral boundaries of said non-magnetic cover are formed complementary to one another.

9. The equipment according to claim 1 wherein said code carrier is fastened to one of the guide rails in a magnetic self-adhering manner.

10. Equipment for ascertaining the absolute position of an elevator car movable along guide rails over a travel path in an elevator installation comprising:

a car guide rail having a longitudinally extending receiving groove formed therein extending along the travel path of the elevator car;

a code carrier received in said groove and extending along the travel path of the elevator car, said code carrier having code marks of different permeability alternately in succession extending in the direction of travel of the elevator car; and a non-magnetic cover attached to said code carrier and externally covering said code marks.

11. The equipment according to claim 10 wherein said non-magnetic cover is formed of a metallic material.

12. The equipment according to claim 10 wherein said receiving groove is formed laterally at a guide flange of said guide rail.

13. The equipment according to claim 10 wherein said receiving groove is formed at an end face of a guide flange of said guide rail.

14. The equipment according to claim 10 wherein said non-magnetic cover is inserted into said receiving groove to be flush with an outer surface of said guide rail.

15. The equipment according to claim 10 wherein said non-magnetic cover is formed as a strip with lateral boundaries projecting laterally beyond said code carrier, and wherein lateral surfaces of said receiving groove and said lateral boundaries of said non-magnetic cover are formed complementary to one another.

16. The equipment according to claim 10 wherein said code carrier is fastened to said guide rail in a magnetic self-adhering manner.

17. Equipment for ascertaining the absolute position of an elevator car movable along guide rails over a travel path in an elevator installation comprising:

a car guide rails having a longitudinally extending receiving groove formed therein extending along the travel path of the elevator car;

a code carrier received in said groove and extending along the travel path of the elevator car, said code carrier having code marks of different magnetic permeability spaced apart in the direction of travel of the elevator car; and a non-magnetic cover attached to said code carrier and externally covering said code marks, said non-magnetic cover being flush with an outer surface of said guide rail.

* * * * *